US007717325B2

(12) United States Patent
Puls et al.

(10) Patent No.: US 7,717,325 B2
(45) Date of Patent: May 18, 2010

(54) DOUBLE WALL CONTAINER WITH INTERNAL SPACER

(75) Inventors: Craig R. Puls, Slinger, WI (US); Jozef Milewski, Richfield, WI (US); Bruce J. Thoman, Lebanon, OH (US); Wei Li, Mason, OH (US); Richard A. Tedford, Loveland, OH (US)

(73) Assignee: International Paper Company, Memphis, TN (US)

( * ) Notice: Subject to any disclaimer, the term of this patent is extended or adjusted under 35 U.S.C. 154(b) by 261 days.

(21) Appl. No.: 11/906,524

(22) Filed: Oct. 1, 2007

(65) Prior Publication Data

US 2008/0078825 A1 Apr. 3, 2008

Related U.S. Application Data

(60) Provisional application No. 60/848,181, filed on Sep. 29, 2006.

(51) Int. Cl.
*B65D 3/00* (2006.01)
*A47J 39/00* (2006.01)

(52) U.S. Cl. ..... 229/403; 229/400; 220/592.17

(58) Field of Classification Search ..... 229/403, 229/400; 220/592.17
See application file for complete search history.

(56) References Cited

U.S. PATENT DOCUMENTS

| | | | | |
|---|---|---|---|---|
| 1,771,765 | A | 7/1930 | Benson | |
| 2,266,828 | A | 12/1941 | Sykes | |
| 2,675,954 | A | 4/1954 | Vogel | |
| 3,079,027 | A | 2/1963 | Edwards | |
| 3,082,900 | A * | 3/1963 | Goodman | 220/592.17 |
| 3,169,689 | A | 2/1965 | Schwartz | |
| 3,208,631 | A | 9/1965 | Edwards | |
| 3,456,860 | A | 7/1969 | Janninck | |
| 3,526,316 | A | 9/1970 | Kalogris | |
| 3,580,468 | A | 5/1971 | McDevitt | |
| 3,675,954 | A | 7/1972 | Konig | |
| 4,007,670 | A | 2/1977 | Albano et al. | |
| 4,049,122 | A | 9/1977 | Maxwell | |
| 4,231,476 | A | 11/1980 | Compton et al. | |
| 4,261,501 | A | 4/1981 | Watkins et al. | |
| 4,435,344 | A | 3/1984 | Iioka | |
| 5,145,107 | A | 9/1992 | Silver et al. | |
| 5,205,473 | A | 4/1993 | Coffin, Sr. | |
| 5,226,585 | A * | 7/1993 | Varano | 229/400 |

(Continued)

FOREIGN PATENT DOCUMENTS

| | | |
|---|---|---|
| DE | 4226313 | 2/1994 |

(Continued)

*Primary Examiner*—Gary E Elkins
*Assistant Examiner*—Latrice Byrd
(74) *Attorney, Agent, or Firm*—Thomas W. Barnes, III; Thomas W. Ryan, III

(57) ABSTRACT

A container according to a preferred embodiment of the present invention provides an inner wall and an outer wall wrapped therearound so as to define a double-wall container construction. A plurality of spacer elements are interposed between the inner and the outer walls so as to maintain a minimum thickness of an air space defined therebetween. In normal use conditions, the spacer elements do not contact the inner wall; however, the spacer elements prevent the outer wall from contacting the inner wall during non-standard use conditions.

15 Claims, 3 Drawing Sheets

U.S. PATENT DOCUMENTS

| | | | | | |
|---|---|---|---|---|---|
| 5,326,019 | A | | 7/1994 | Wolff | |
| 5,425,497 | A | | 6/1995 | Sorensen | |
| 5,460,323 | A | * | 10/1995 | Titus | 229/403 |
| 5,469,983 | A | | 11/1995 | Yawata | |
| 5,524,817 | A | | 6/1996 | Meier et al. | |
| 5,542,599 | A | | 8/1996 | Sobol | |
| 5,628,453 | A | * | 5/1997 | MacLaughlin | 229/403 |
| 5,667,135 | A | | 9/1997 | Schaefer | |
| 5,685,480 | A | | 11/1997 | Choi | |
| 5,697,550 | A | * | 12/1997 | Varano et al. | 229/403 |
| 5,713,512 | A | | 2/1998 | Barrett | |
| 5,746,372 | A | * | 5/1998 | Spence | 229/403 |
| 5,752,653 | A | | 5/1998 | Razzaghi | |
| 5,775,577 | A | | 7/1998 | Titus | |
| 5,794,843 | A | | 8/1998 | Sanchez | |
| 5,826,786 | A | | 10/1998 | Dickert | |
| 5,839,653 | A | * | 11/1998 | Zadravetz | 229/403 |
| 5,842,633 | A | | 12/1998 | Nurse | |
| 5,950,917 | A | * | 9/1999 | Smith | 229/403 |
| 5,964,400 | A | | 10/1999 | Varano et al. | |
| 6,068,182 | A | | 5/2000 | Tokunaga | |
| 6,085,970 | A | | 7/2000 | Sadlier | |
| 6,109,518 | A | | 8/2000 | Mueller et al. | |
| 6,152,363 | A | | 11/2000 | Rule, Jr. | |
| 6,193,098 | B1 | | 2/2001 | Mochizuki et al. | |
| 6,663,926 | B1 | | 12/2003 | Okushita et al. | |
| 7,100,770 | B2 | | 9/2006 | D'Amato | |

FOREIGN PATENT DOCUMENTS

| | | |
|---|---|---|
| DE | 19840841 | 3/2000 |
| EP | 1227042 | 4/2004 |
| EP | 1227043 | 6/2004 |
| EP | 1830056 | 9/2007 |
| EP | 1031514 | 10/2007 |
| GB | 1261532 | 1/1972 |
| JP | 8276927 | 10/1996 |
| JP | 2000118521 | 4/2000 |
| JP | 2000142834 | 5/2000 |
| JP | 2000226022 | 8/2000 |
| WO | WO 94/03326 | 2/1994 |

* cited by examiner

DOUBLE WALL CONTAINER WITH INTERNAL SPACER

BACKGROUND OF THE INVENTION

1. Technical Field of the Invention

The present invention relates to thermally insulated containers for storing beverages, and more particularly, for storing hot beverages such as coffee, tea and cocoa. More particularly, the present invention relates to thermally insulated containers for storing beverages, wherein the container is provided with a double wall construction, and wherein internal spacer elements are provided to maintain a minimum distance between the individual walls of the double wall construction.

2. Brief Description of the Related Art

Common single-use coffee cups are primarily made of paperboard or polystyrene. It is well known that the thermal insulation characteristics of polystyrene cups are far superior to those of either kraft paper or bleached paperboard cups. When a hot beverage, such as coffee, tea or cocoa, is poured into a single-use cup, the cup surface temperature rises to a maximum in a few seconds, then slowly cools with the beverage back to ambient temperature. If the maximum cup surface temperature exceeds about 140 degrees F., it is painful for an individual to hold the cup. The surface of a common polystyrene cup, nominally 0.090 in. thick, does not reach this threshold, but that of any single paperboard cup almost always exceeds it.

It is well known to employ various sleeve designs for cups which emphasize insulation capabilities. Exemplary of such sleeves are U.S. Pat. No. 5,205,473 ('473) to D. W. Coffin, Sr., entitled "Recyclable Corrugated Beverage Container and Holder," U.S. Pat. No. 5,425,497 ('497) to J. Sorensen, entitled "Cup Holder," U.S. Pat. No. 5,667,135 ('135) to R. J. Schaefer, entitled "Thermal Insulating Sleeve for Drink Cups," U.S. Pat. No. 5,746,372 ('372) to 0. Spence, entitled "Biodegradable Cup Holder," U.S. Pat. No. 5,794,843 ('843) to R. S. Sanchez, entitled "Cup Wrap," U.S. Pat. No. 5,826,786 ('786) to J. Dickert, entitled "Cup Holder Sleeve in Pre-Assembled Flat-Folded Form," and U.S. Pat. No. 5,842,633 ('633) to R. I. Nurse, entitled "Sleeve for Beverage Cups." While these references disclose various sleeves for use on beverage containers, none of these are particularly quantitative on the sleeve characteristics needed for good insulation.

It is also known to employ cup designs that emphasize insulation. Exemplary of such cup designs are U.S. Pat. No. 4,007,670 ('670) to J. V. Albano et al., entitled "Insulated Container," U.S. Pat. No. 4,261,501 ('501) to J. B. Watkins et al., entitled "Laminated Insulated Hot Drink Cup," U.S. Pat. No. 4,435,344 ('344) to A. Iioka, entitled "Method for Producing a Heat-Insulating Paper Container From a Paper Coated or Laminated With a Thermoplastic Synthetic Resin Film," U.S. Pat. No. 5,145,107 ('107) to V. K. Silver et al., entitled "Insulated Paper Cup," U.S. Pat. No. 5,226,585 ('585) to R. Varano, entitled "Disposable Biodegradable Insulated Container and Method for Making," U.S. Pat. No. 5,460,323 ('323) to J. H. Titus, entitled "Disposable Insulated Container," U.S. Pat. No. 5,542,599 ('599) to R. E. Sobol, entitled "Biodegradable Thermally Insulated Beverage Cup," U.S. Pat. No. 5,628,453 ('453) to D. M. MacLaughlin, entitled "Cup With Thermally Insulated Side Wall," U.S. Pat. No. 5,697,550 ('550) to R. Varano et al., entitled "Multi-Layered Insulated Cup Formed From Folded Sheet," U.S. Pat. No. 5,713,512 ('512) to R. K. Barrett, entitled "Polymeric Insulated Container," U.S. Pat. No. 5,752,653 ('653) to M. Razzaghi, entitled "Paper Cup With Air Insulation," U.S. Pat. No. 5,775,577 ('577) to J. H. Titus, entitled "Disposable Insulated Container With Microflute Structure," and U.S. Pat. No. 5,839,653 ('653) to R. B. Zadravetz, entitled "Container With Corrugated Wall." While a number of these references identify the effectiveness of an air gap and the providing of good insulation properties, they do not incorporate the simplicity of a sleeve cut from a single blank, add an air gap which is constructed of hot-melt glue dots, and employ a smooth outside-sleeve surface for printing.

It is apparent from the above that there exists a need in the art for a sleeve construction which is lightweight through simplicity of parts and uniqueness of structure, but which incorporates a sleeve cut from a single blank, adds an air-gap layer, and preserves a smooth outside-sleeve surface for printing. It is the purpose of this invention to fulfill this and other needs in the art in a manner more apparent to the skilled artisan once given the following disclosure.

U.S. Pat. No. 6,152,363 ('363) to J. A. Rule, entitled "Sleeve Construction for Improved Paperboard Cup Insulation," teaches a beverage container sleeve construction which employs a matrix of hot-melt glue dots printed on one surface thereof for the purpose of maintaining a preselected distance between the sleeve and a complimentary beverage cup, around which the sleeve is wrapped. According to such a construction, the glue dots (and not the paperboard sleeve onto which the dots are printed) contact the outer surface of the cup, thereby defining an air gap between the sleeve and the cup such that a user's fingers gripping the sleeve will not be burned by the cup. However, there remains a need to improve upon an overall container construction incorporating such a technique for maintaining an air gap between complimentary walls of a double-wall beverage container.

Single layer paper cup technology does not have the ability to keep beverages or drinks warm, and at the same time protect the hand from becoming uncomfortable from holding a hot liquid or material. Similarly, a simple single layer cup or container construction does not have the ability to insulate a cold beverage or product and protect the exterior of the cold container from moisture condensation that can pool on the bottom of the container and stain furniture or the interior finish of cars and vehicles.

Many past container products have used very expensive solutions, such as an insulated foam laminate or a corrugated paper spacer to create cup sidewall thickness and this attempt to create hand-hold protection, in addition to heat- and cold-retention in the beverage or food product contained therein. All of the built-up laminated approaches to producing a thick-walled insulated cup require very unique and expensive converting equipment to manufacture a blank used to form the cup, plus an additional piece of equipment to wrap the resulting blank into a cup or container. A more simplified and high-speed system is required that could replace the high cost of a specialty blank converting manufacturing system.

SUMMARY OF THE INVENTION

The present invention involves, among other things, the manufacture of an insulated cup by using a very small number of spacer elements (e.g., dots or horizontal lines) that are printed, sprayed, laminated or extruded onto an outer wrap of a paper cup or container. The printing, spraying, laminating or extruding of the spacer elements can be done either off-line on existing equipment or can be done in-line on the cup-forming equipment.

Once the spacer elements are applied to the exterior blank, the blank can then be wrapped around a cup. The spacer dots create an air space between the inner and outer blanks, thereby defining an insulating air space therebetween. The spacer elements can be made from acrylics or other plastics, hot melt, foamed starch or cellulose material, adhesives, glues, cork or other natural fibers and/or insulating materials. Virtually any material can be used to define the spacer elements that can be processed using conventional laminating, printing, spraying or extruding equipment, or that can be indexed (via label applicator or pick-and-place systems) onto the surface of the outer blank. It should be recognized that the spacer elements may, alternatively, be applied to the outside surface of the interior blank that forms, in part, the inner wall. Then, the outside blank may be wrapped around the cup in a manner such that it covers a minority, a majority, and/or the entire surface area of the outside surface of the inner wall of the cup.

The outer blank can be made of virgin or recycled paper, or virtually any grade of paper or paperboard to meet a specific end-use need. A specific grade of paper can be selected that would absorb the condensate that occurs from cold beverages, thereby creating an absorbable or sweat-resistant insulated cup. Clay-coated grades of paper can be utilized on the outer blank to enhance the printing and graphics of the insulated cup. Similarly, synthetic films and plastic sheet material may be utilized, if desired. The use of any naturally-occurring plastic film, fibrous raw material or naturally-occurring insulated material could also be used for the exterior of the insulated cup.

Once the outer wrap is applied to the cup, an integral insulated cup has been created with an air pocket having been designed into the insulated cup due to the spacers. The number of spacer elements can vary from few to many, depending on the inherent stiffness of the inner and outer cup walls. The degree of insulation can be improved with thicker spacers vs. thinner spacers.

The inner cup that is being used to produce the insulated container may use a variety of raw materials and thicknesses to achieve the cost and overall hand-holding characteristics desired for the insulated cup.

These and other objects, features and advantages of the present invention become apparent to those of ordinary skill in the art from the description which follows, and may be realized by means of the instrumentalities and combinations particularly pointed out therein, as well as by those instrumentalities, combinations and improvements thereof which are not described expressly therein, but which would be obvious to those of ordinary and reasonable skill in the art.

BRIEF DESCRIPTION OF THE DRAWINGS

A better understanding of the invention will be had upon reference to the following description in conjunction with the accompanying drawings in which like reference numerals represent like parts, and wherein.

DETAILED DESCRIPTION OF THE PREFERRED EMBODIMENTS

Figure 1:
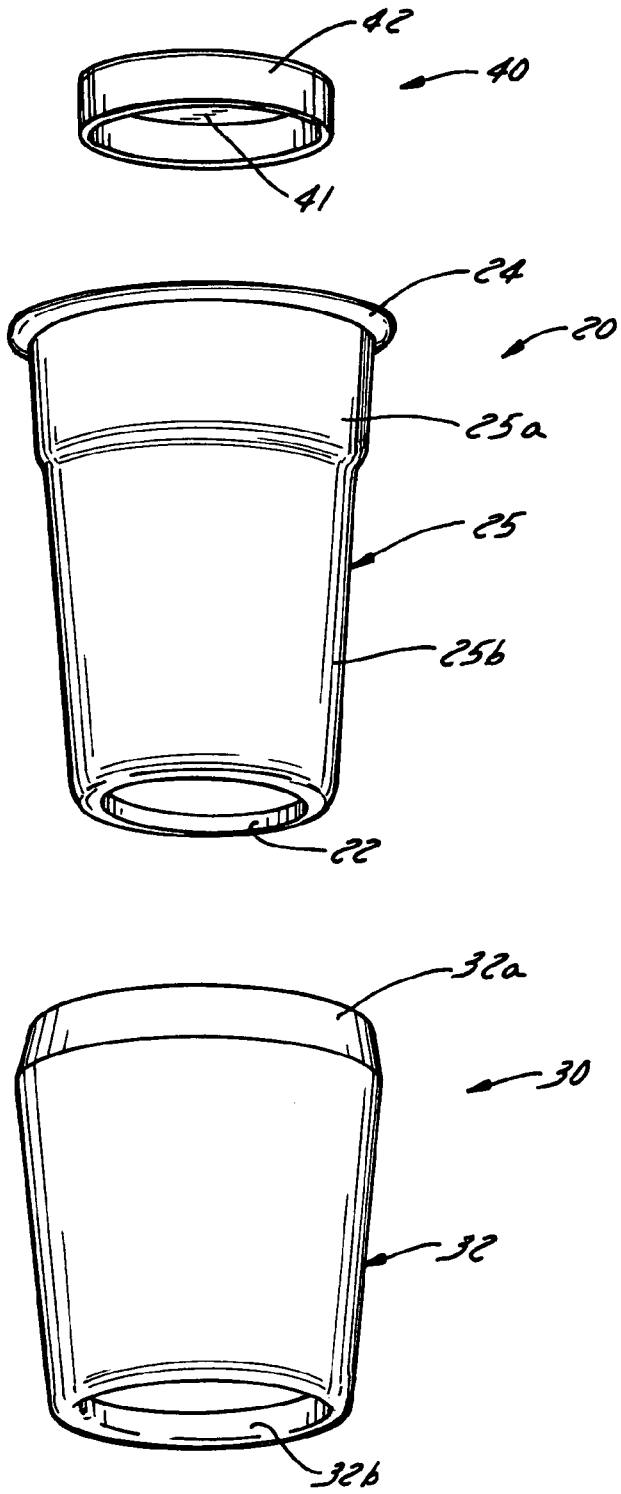
FIG. 1 is an exploded view of a beverage container according to a preferred embodiment of the present invention.

With reference to FIG. 1, a container 10 according to a preferred embodiment of the present invention includes an inner wall 20, an outer wall 30 and a cup bottom 40, each telescopingly fit one over the other so as to define an open-top, closed-bottom, double-wall cup configuration, as is known generally in the art. More particularly, the cup bottom 40 fits within the inner wall 20 and is positioned generally near a lower end thereof. The cup bottom 40 is defined by a circular top 41 and a downwardly-depending annular leg 42. The lower end of the inner wall 20 includes an inwardly- and upwardly-turned annular lip 22 into which the annular leg 42 of the cup bottom 40 is captured and pinched so as to define a leak-proof closed lower end of the container 10. The inner wall 20 is further provided with an outwardly-rolled bead 24 and a generally-cylindrical sidewall 25 extending between the rolled bead 24 and the annular lip 22. In some cases, the cup bottom 40 may be fixedly attached to the inner wall 20, e.g. the cup bottom 40 and the inner wall 20 may be made out of identical raw materials, for example, the identical continuous substrate such as a paper substrate.

Inner wall sidewall 25 more particularly includes a generally-cylindrical upper portion 25*a* positioned adjacent the rolled bead 24 and an inwardly-tapered frusto-conical main body portion 25*b* positioned adjacent the annular lip 22. As can be seen from the figures, main body portion 25*b* preferably is more substantial than upper portion 25*a*, the purpose of which will be described in greater detail below. Upper portion 25*a* and main body portion 25*b* are connected to one another by a shoulder 26, which serves as an inwardly-directed discontinuous radial transition from the upper portion 25*a* to the main body portion 25*b*. Inner wall 20 and cup bottom 40 each preferably are constructed from coated or uncoated paperboard and are manufactured to achieve the within-described configurations using ordinary manufacturing techniques. In some case, the inner wall 20 may include the main body portion 25*b* positioned directly adjacent the rolled bead 24 in the absence of the upper portion 25*a* and shoulder 26 therebetween.

Outer wall 30 includes an inwardly-tapered frusto-conical sleeve portion 32 having an inwardly-tapered upper end 32*a* and an inwardly- and upwardly-rolled lower lip 32*b*, the purpose of which will be described in greater detail below. Outer wall 30 is sized to fit around inner wall 20, which is telescopingly-received thereinto so as to define a double-wall container configuration. Outer wall 30 preferably is constructed from coated or uncoated paperboard and is manufactured to achieve the within-described configuration using ordinary manufacturing techniques.

Figure 3:
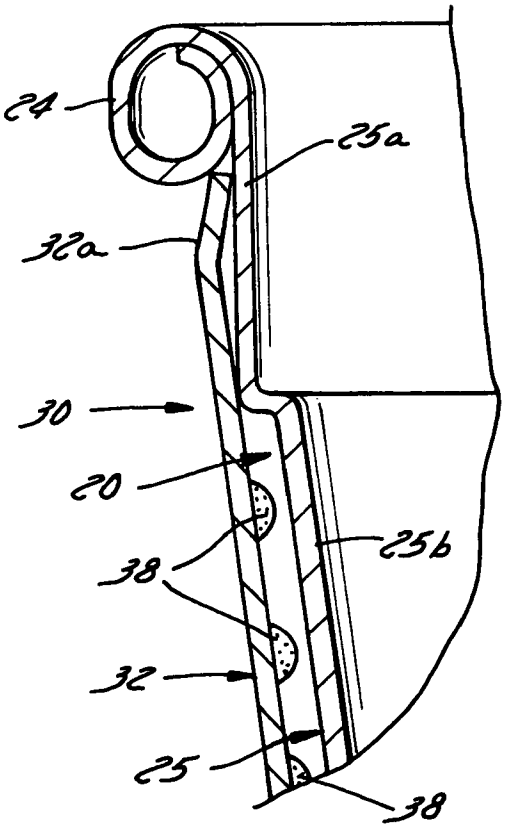
FIG. 3 is a close-up partial section view of an upper portion of the container of FIG. 1, showing an upper end of an outer wall being affixed to a generally-cylindrical portion of an inner wall and showing the outer wall being in spaced relation to the inner wall; and, FIG. 4 is a top plan view of a blank used to form an outer wall portion of the container shown in FIG. 1.
Figure 2:
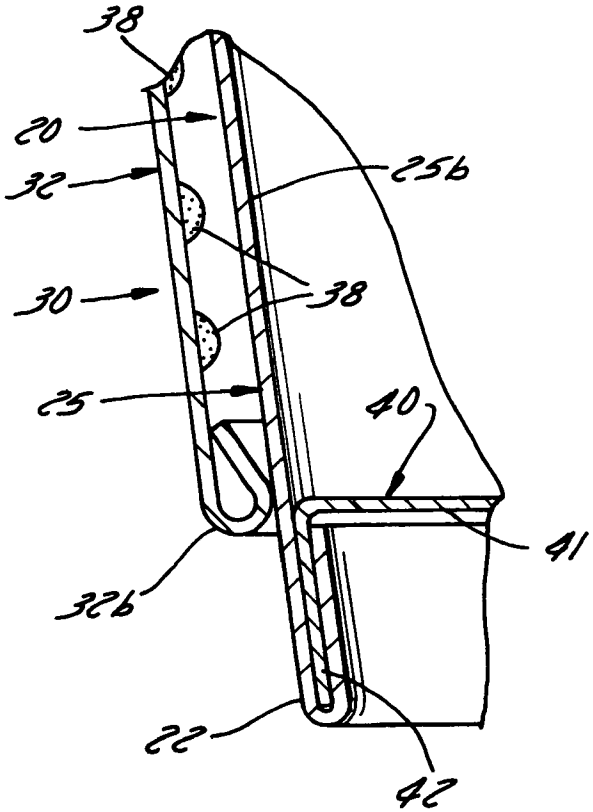
FIG. 2 is a close-up partial section view of a lower portion of the container of FIG. 1, showing a cup bottom being captured by an inwardly-turned lip of an inner wall and showing an outer wall being in spaced relation to the inner wall.

With reference now also to FIGS. 2 and 3, the manner in which inner wall 20, outer wall 30 and cup bottom 40 are arranged so as to form an open-top, closed-bottom, generally leak-proof beverage container 10 is described. As mentioned above, cup bottom 40 is formed preferably from a flat, circular sheet of coated paperboard, which is folded downwardly along out periphery so as define circular top 41 and annular leg 42. The cup bottom 40, thus formed, is positioned towards the lower end of the inner wall 20, which is formed by wrapping a flat sheet of coated paperboard around a mandrel (not shown) and sealing opposing ends (not shown) to one another, as is customary in cup-forming techniques. Lip 22 is folded inwardly and upwardly so as to capture and pinch cup bottom leg 42 therein. Lip 22 and leg 42 and then sealed to one another so as to define a generally leak-proof closed bottom of the container 10.

Outer wall 30 is thereafter wrapped around inner wall 20 using conventional cup-forming and wrapping techniques such that the inwardly-tapered upper end 32*a* of the outer wall 30 is positioned adjacent rolled bead 24 of the inner wall 20 and secured to the cylindrical portion 25*a* thereof, such as, for example, using coventional adhesive, heat or sonic sealing techniques. Rolled lower lip 32*b* of the outer wall 30 is allowed to rest against an outer surface of the inner wall 20, near the lower end thereof, preferably adjacent the top 41 of the cup bottom 40, which is positioned within the inner wall 20. Alternatively, at least one of the spacer elements 28 may be positioned where the rolled lower lip 32*b* of the outer wall 30 is allowed to rest against the outer surface of the inner wall 20 in addition to and/or to replace the rolled lower lip 32*b*.

As can be seen clearly in FIG. 3, upper portion 25*a* of the inner wall 20 cooperates with shoulder 26 to ensure that an upper portion of the outer wall 30 is spaced outwardly from inner wall 20, thereby defining an insulating air spaced therebetween. Similarly, FIG. 2 shows clearly that rolled lower lip 32*b* ensures that a lower portion of the outer wall 30 is spaced outwardly from the inner wall, thereby defining a generally-constant thickness insulating air gap vertically from top-to-bottom of the container 10.

Figure 4:
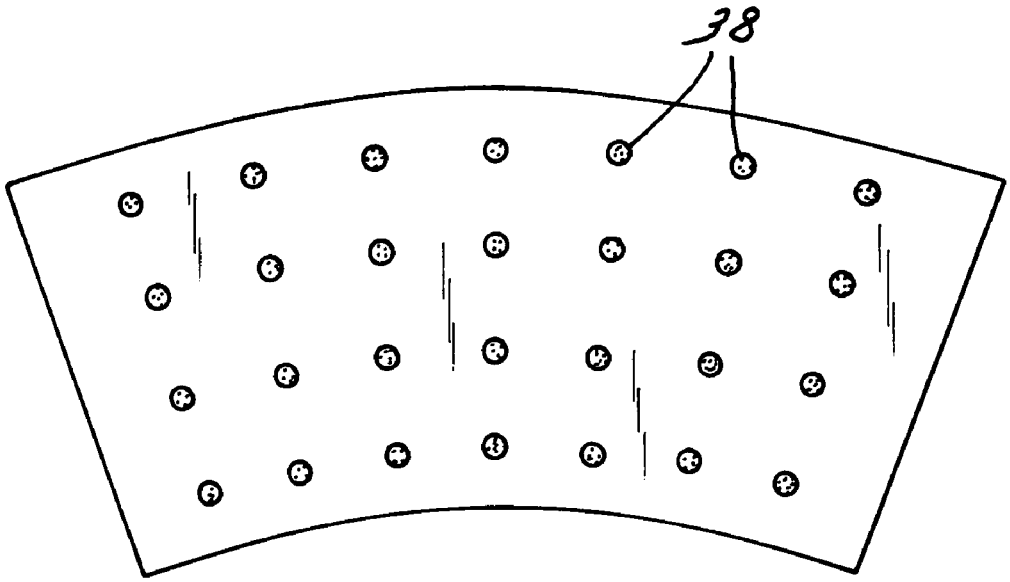

Referring now to FIG. 4, a blank used to form the outer wall 30 is shown onto which a plurality of spacer elements 38, in the form of dots, have been printed or otherwise applied or deposited onto the surface of the blank. Although the spacer elements 38 may be arranged to form a matrix or other pattern, a random arrangement thereof may also be provided. In addition, although the spacer elements 38 are shown in the form of generally-circular dots, any shape thereof may be employed while staying within the spirit and scope of the present invention. Indeed, spacer elements may even take the form of stripes, ribs, ridges or other elongated configurations arranged either in parallel to one another or at angles relative to one another. Alternatively, the dots may be replaced with lines, either horizontal and/or vertical. If the lines are horizontal lines, the horizontal lines may be vertically spaced from the rolled bead 24. If the lines are vertical lines, the vertical lines may be horizontally spaced.

Referring now back to FIGS. 2 and 3, it can be seen that spacer elements 38 extend from the outer wall 30 into the interior space defined by the inner wall 20 and the outer wall 30, towards the inner wall 20, but do not contact the inner wall 20 when the container 10 is in a relaxed (i.e., ungripped) state. The purpose of this is so that the interior space between the inner wall 20 and the outer wall 30 is substantially free from obstructions so as to maximize the movement of air therebetween, which is heated (or chilled) in response the beverage contained within the inner wall 20. Allowing for the movement of such air eliminates localized pockets of hot (or cold) temperatures and facilitates an effective thermal equilibrium generally throughout the interior space between the inner wall 20 and the outer wall 30. It should be noted that at least one of the spacer elements 38 may, alternatively, be attached to the inner wall 20, extending therefrom into the interior space between the inner wall 20 and the outer wall 30, but yet does not contact the outer wall when the container is in a relaxed state (ungripped) for the same purposes as mentioned above. Moreover, at least one spacer element 38 may alternatively be in contact with both the inner wall 20 and the outer wall 30 (and/or attached to either and/or both the inner wall 20 and the outer wall 30) in the relaxed state (ungripped).

In use, a user grips the outside surface of the outer wall 30. However, in ordinary use, the stiffness of the outer wall 30 is sufficient to prevent the outer wall 30 from contacting the inner wall 20 under the influence of the user's squeezing same. The spacer elements 38 are sized such that they do not come into contact with the inner wall 20 during normal use conditions. However, in the event the stiffness of the outer wall 30 is sufficiently low (or the user exerts a larger-than-normal squeezing force to the container) such that the outer wall 30 would come into contact with the inner wall 20 during normal use conditions, the spacer elements 38 would stop inward movement of the outer wall 30 relative to the inner wall 20 beyond a certain point so as to ensure that a minimum thickness to the air space defined therebetween is maintained.

In an alternative preferred embodiment, the container of the present invention may have a bottom, an inner wall having a main body portion and a rolled bead, an outer wall and a plurality of spacer elements that are attached to the inner surface of the outer wall and are defined by rows of horizontal line elements vertically spaced from the top edge of the outer wall to the bottom edge of the outer wall such that the closest element to the bottom edge of the outer wall is located at along the bottom edge of the outer wall. The elements project into the interior space between the inner wall and the outer wall and preferably do not contact the inner wall when in the relaxed (ungripped position).

While the invention has been described and illustrated with reference to one or more preferred embodiments thereof, it is not the intention of the applicants that the invention be restricted to such detail. Rather, it is the intention of the applicants that the invention be defined by all equivalents, both suggested hereby and known to those of ordinary skill in the art, of the preferred embodiments falling within the scope hereof.

We claim:

1. A container, comprising:

an outer wall;

an inner wail disposed within the outer wall and spaced therefrom by a distance;

a cup bottom affixed to a lower end of the inner wall; wherein said outer wall includes a plurality of spacer elements disposed thereon so as to maintain a minimum distance between said inner wall and said outer wall during normal use conditions, wherein said spacer elements are positioned between said inner wall and said outer wall in a manner such that an uninterrupted air space is maintained between said inner wail and outer wall and said spacer elements project from an inner surface of said outer wall into an interior s ace between said outer wall and said inner wall such that said spacer elements do not contact said inner wall when said container is in a relaxed state that is not gripped by a user of said container.

2. The container according to claim 1, wherein said inner wall comprises a main body portion adjacent a rolled bead located at the top edge of the outer wall.

3. The container according to claim 1, wherein said inner wall comprises an annular lip.

4. The container according to claim 3, wherein said cup bottom comprises a circular top and an annular leg.

5. The container according to claim 4, wherein said cup bottom is positioned towards the lower end of the inner wall.

6. The container according to claim 5, wherein said lower end of said inner wall is formed by wrapping a flat sheet of coated paperboard around a mandrel and sealing opposing ends to one another.

7. The container according to claim 5, wherein said annular lip of said inner wall is in contact with said annular leg.

8. The container according to claim 7, wherein said annular lip and annular leg are sealed to be leak proof.

9. The container according to claim 8, wherein said spacer elements are defined by horizontal lines that are vertically spaced from the top of said container.

10. The container according to claim 9, wherein at least one of said spacer elements is positioned near the bottom edge of said outer wall and adjacent a top of said bottom of said container that is positioned with the inner wall.

11. The container according to claim 1, wherein said spacer elements project from an inner surface of said outer wall into an interior space between said outer wall and said inner wall such that said spacer elements do not contact said inner wall when said container is in a relaxed state that is not gripped by a user of said container.

12. A method of making the container according to claim 1, comprising applying said spacer elements to an interior surface of said outer wall, sealing said bottom to said inner wall so as to form a container bottom that is leak proof, and wrapping said outer wall over said inner wall.

13. A method of reducing transmittance of heat from inside surface of a container to an outside surface of a container, comprising applying at least one spacer element to an outer wall of a container comprising an inner wall and said outer wall in a manner such that said spacer element projects into a space therebetween said outer wall and inner wall but does not contact said inner wall, wherein spacer elements project from an inner surface of said outer wall into an interior space between said outer wall and said inner wall said such tat said spacer elements do not contact said inner wall when said container is in a relaxed state that is not gripped by a user of said container and said spacer elements are positioned between said inner wall and said outer wall in a manner such that an uninterrupted air space is maintained between said inner wall and outer wall when said container is in a relaxed state that is not gripped by a user of said container.

14. A container, comprising:

an outer wall;

an inner wall disposed within the outer wall and spaced therefrom by a distance;

a cup bottom affixed to a lower end of the inner wall; wherein said inner wall includes a plurality of spacer elements disposed thereon so as to maintain a minimum distance between said inner wall and said outer wall during normal use conditions, where said spacer elements are positioned between said inner wall and said outer wall in a manner such that an uninterrupted air space is maintained between said inner wall and said outer wall and said spacer elements project from an outer surface of said inner wall into an interior space between said outer wall and said inner wall such that said spacer elements do not contact said outer wall when said container is in a relaxed state that is not gripped by a user of said container.

15. A method of reducing transmittance of heat from inside surface of a container to an outside surface of a container, comprising applying at least one spacer element to an inner wall of a container comprising an inner wall and said outer wall in a manner such that said spacer element projects into a space therebetween said outer wall and inner wall but does not contact said outer wall, wherein spacer elements project from an outer surface of said inner wall into an interior space between said outer wall and said inner wall said such that said spacer elements do not contact said inner wall when said container is in a relaxed state that is not gripped by a user of said container and said spacer elements are positioned between said inner wall and said outer wall in a manner such that an uninterrupted air space is maintained between said inner wall and outer wall when said container is in a relaxed state that is not gripped by a user of said container.

* * * * *